US008590461B2

(12) United States Patent
López Gómez

(10) Patent No.: US 8,590,461 B2
(45) Date of Patent: Nov. 26, 2013

(54) DEVICES TO SHIFT THE STOPS OF RAIL VEHICLE BODIES WITH BOGIES ON CURVES AND RAIL VEHICLE BODY WITH BOGIES

(75) Inventor: José Luis López Gómez, Madrid (ES)

(73) Assignee: Patentes Talgo, S.L., Madrid (ES)

( * ) Notice: Subject to any disclaimer, the term of this patent is extended or adjusted under 35 U.S.C. 154(b) by 210 days.

(21) Appl. No.: 13/139,929

(22) PCT Filed: Dec. 15, 2009

(86) PCT No.: PCT/ES2009/070591
§ 371 (c)(1),
(2), (4) Date: Aug. 30, 2011

(87) PCT Pub. No.: WO2010/070179
PCT Pub. Date: Jun. 24, 2010

(65) Prior Publication Data

US 2011/0297036 A1 Dec. 8, 2011

(30) Foreign Application Priority Data

Dec. 15, 2008 (ES) ..... 200803553

(51) Int. Cl.
*B61F 5/38* (2006.01)

(52) U.S. Cl.
USPC ..... 105/199.2; 105/185

(58) Field of Classification Search
USPC ..... 105/185, 199.1, 199.2, 201
See application file for complete search history.

(56) References Cited

U.S. PATENT DOCUMENTS

| | | | | |
|---|---|---|---|---|
| 2,874,647 | A | 2/1959 | Candlin, Jr. | |
| 3,913,495 | A * | 10/1975 | Pelabon | 105/199.3 |
| 4,625,652 | A * | 12/1986 | Losa et al. | 105/4.1 |
| 4,773,334 | A * | 9/1988 | Nowak et al. | 105/182.1 |
| 2011/0185938 | A1* | 8/2011 | Lopez Gomez | 105/4.4 |

FOREIGN PATENT DOCUMENTS

| | | |
|---|---|---|
| CH | 358464 | 11/1961 |
| GB | 19105402 | 11/1910 |
| WO | 8200120 | 1/1982 |

OTHER PUBLICATIONS

PCT/ES2009/070591 International Search Report.

* cited by examiner

*Primary Examiner* — Zachary Kuhfuss
(74) *Attorney, Agent, or Firm* — Michael Best & Friedrich LLP

(57) ABSTRACT

Devices to shift the stops (8) of rail vehicle bodies or coaches with bogies on curves and rail vehicle body with bogies. The devices are provided in an interior cavity of the frame of the bogies whose lateral edges each have a separate stop (9, 10) and that houses a lower projecting part (4) of the body. In one embodiment, on the front edge of the interior cavity of the frame (1) of the bogie, there is a pair of joints (11) from each of which a rod (5, 6) leads backwards and each of these is joined to a separate slider (7) by means of joints. The sliders (7) are able to move on guides located on the respective lateral surfaces of the lower projecting part (4) of the body, and the sliders (7) are wedge shaped with a guide located on their surface in the form of an inclined plane. The stops (8) of the body are coupled, at their respective inside surfaces, to the guides located on the respective sliders (7); the stops (8) of the body are joined together by transversal connection means (15).

27 Claims, 9 Drawing Sheets

DEVICES TO SHIFT THE STOPS OF RAIL VEHICLE BODIES WITH BOGIES ON CURVES AND RAIL VEHICLE BODY WITH BOGIES

BACKGROUND

This invention refers to devices to shift the stops of rail vehicle bodies or coaches with bogies when they are entering a curve, and to a rail vehicle body with bogies.

Moving equipment in general, when running on a curved track or rail, are naturally subjected to a lateral thrust towards the outside thereof (due to the centrifugal force) which, in the case of railway vehicles, leads to a tendency to tilt towards the outside and for the bodies to swivel in the same direction. The pendular type suspension developed by the applicant for the family of Pendular Talgo trains (which is described, for example, in the applicant's Spanish patent 424615 as "pendular suspension system") succeeded in reversing the direction of this swivel such that, in these trains, the vehicle bodies, when running along curves, naturally tilt "towards the inside" of the curves. This makes it possible to considerably reduce the lateral force to which people who are traveling inside the vehicle bodies are inevitably subjected when they pass through the curves.

Coaches equipped with bogies have a lateral clearance between the sides of the bogie frame and a lower part of the body that is located in the interior cavity bounded by the frame of that bogie. To prevent the coaches from tilting on undergoing movements due to lateral forces (e.g., when traveling along a curve), lateral stops are placed in the bogie frame that limit the lateral movement of the body, or relative movement of the body with respect to the bogie.

When running along a curve at low speed, especially vehicles equipped with pendular suspension, the centrifugal force is very small and does not offset the natural movement towards the inside of the curve that, for example, is characteristic of this suspension; therefore, in practice, the body shifts towards the inside of the curve. The lateral shift of the body towards the inside of the curve should be accounted for when designing the body dimensions so it can conform with the required outside gauge and thus allow for operation without any interference. This means that, for practical purposes, the width of the coaches can be reduced.

SUMMARY OF THE INVENTION

Therefore, the purpose of this invention is to provide devices to shift the stops of the bodies of a rail vehicle on curves that succeed in limiting the lateral shift of the body towards the inside of the curve with respect to the bogie and, consequently, make it possible to design wider bodies. In addition, the corresponding rail vehicle bodies are provided with bogies that incorporate these devices.

The invention provides a device to shift the stops of rail vehicle bodies with bogies on curves, in which the bogie frame bounds an interior cavity whose lateral edges each has a stop and that houses a lower projecting part of the body, such that there are clearances between these lateral edges of the bogie frame and the corresponding lateral edges of this lower projecting part of the body which, on the front edge of the interior cavity of the bogie frame, comprises a pair of joints arranged symmetrically with respect to the longitudinal axle of the bogie, from each of which a rod leads backwards and on the other end of these each is joined to a slider by means of two joints, each located on an end of each of these sliders; the sliders are able to move on guides located on the respective lateral surfaces of the lower projecting part of the body, and the sliders are wedge shaped with a guide located on their surface in the form of an inclined plane and on which the stops of the body are coupled, at their respective inside surfaces, to the guides located on the inclined planes corresponding to the outside surfaces of the respective sliders; the inside surfaces of the body stops have the same inclination as the inclined planes of the sliders, and the body stops are joined together by guided transversal connection means so as to prevent the longitudinal movement of these body stops with respect to the lower projecting part of the body.

A device is also provided to shift the stops of rail vehicle bodies with bogies on curves, in which the bogie frame bounds an interior cavity whose lateral edges each has a stop and that houses a lower projecting part of the body, such that there are clearances between these lateral edges of the bogie frame and the corresponding lateral edges of this lower projecting part of the body which, on the rear edge of the interior cavity of the bogie frame, comprises a pair of joints arranged symmetrically with respect to the longitudinal axle of the bogie, from each of which a rod leads forwards and on the other end of these each is joined to a slider by means of two joints, each located on an end of each of these sliders; the sliders are able to move on guides located on the respective lateral surfaces of the lower projecting part of the body, and these sliders are wedge shaped with a guide located on their surface in the form of an inclined plane and on which the stops of the body are coupled, at their respective inside surfaces, to the guides located on the inclined planes corresponding to the outside surfaces of the respective sliders; the inside surfaces of the body stops have the same inclination as the inclined planes of the sliders, and the body stops are joined together by guided transversal connection means so as to prevent the longitudinal movement of these body stops with respect to the lower projecting part of the body.

A device is also provided to shift the stops of rail vehicle bodies with bogies on curves, in which the bogie frame bounds an interior cavity whose lateral edges each has a stop and that houses a lower projecting part of the body, such that there are clearances between these lateral edges of the bogie frame and the corresponding lateral edges of this lower projecting part of the body which, on the front edge of the interior cavity of the bogie frame, comprises a pair of joints arranged symmetrically with respect to the longitudinal axle of the bogie, from each of which a rod leads backwards and on the other end of these each is joined to a slider by means of two joints, each located on an end of each of these sliders; the sliders are able to move on guides located on the respective lateral surfaces of the lower projecting part of the body, and the sliders are wedge shaped with a guide located on their surface in the form of an inclined plane and on which each stop of the body is coupled, at its respective inside surface, to the guide located on the inclined plane corresponding to the outside surface of the slider; the inside surface of each stop of the body has the same inclination as the inclined plane of the corresponding slider, and these body stops are joined to the respective lateral surface of the lower projecting part of the body by elastic means and they are guided in the transversal direction by appropriate means of stop ends.

A device is also provided to shift the stops of rail vehicle bodies with bogies on curves, in which the bogie frame bounds an interior cavity whose lateral edges each has a stop and that houses a lower projecting part of the body, such that there are clearances between these lateral edges of the bogie frame and the corresponding lateral edges of this lower projecting part of the body which, on the rear edge of the interior cavity of the bogie frame, comprises a pair of joints arranged symmetrically with respect to the longitudinal axle of the bogie, from each of which a rod leads forwards and on the other end of these each is joined to a slider by means of two joints, each located on an end of each of these sliders; the sliders are able to move on guides located on the respective lateral surfaces of the lower projecting part of the body, and the sliders are wedge shaped with a guide located on their surface in the form of an inclined plane and on which each stop of the body is coupled, at its respective inside surface, to the guide located on the inclined plane corresponding to the outside surface of the slider; the inside surface of each stop of the body has the same inclination as the inclined plane of the corresponding slider, and these body stops are joined to the respective lateral surface of the lower projecting part of the body by elastic means and they are guided in the transversal directions by appropriate means of stop ends.

The invention also provides a railway vehicle body with bogies which comprises two bogies, one located at the front and another located at the rear, and which includes in the interior cavity of the front bogie frame a device to shift the stops of the bodies as per any of the preceding embodiments, and which includes in the interior cavity of the rear bogie frame a device to shift the stops of the bodies that is symmetrical to the former.

With these configurations, the stops of the body can be shifted towards the inside of the curve when the body is in this curve, thus limiting the lateral movement towards the inside of the curve when this body enters the curve.

Another advantage of the device in the invention is that, by making it possible to design wider bodies, the traveler has more space in the interior compartment.

Other characteristics and advantages of this invention will be explained in the following detailed description of some illustrative embodiments of its object in relation to the accompanying figures.

DETAILED DESCRIPTION

Figure 1:
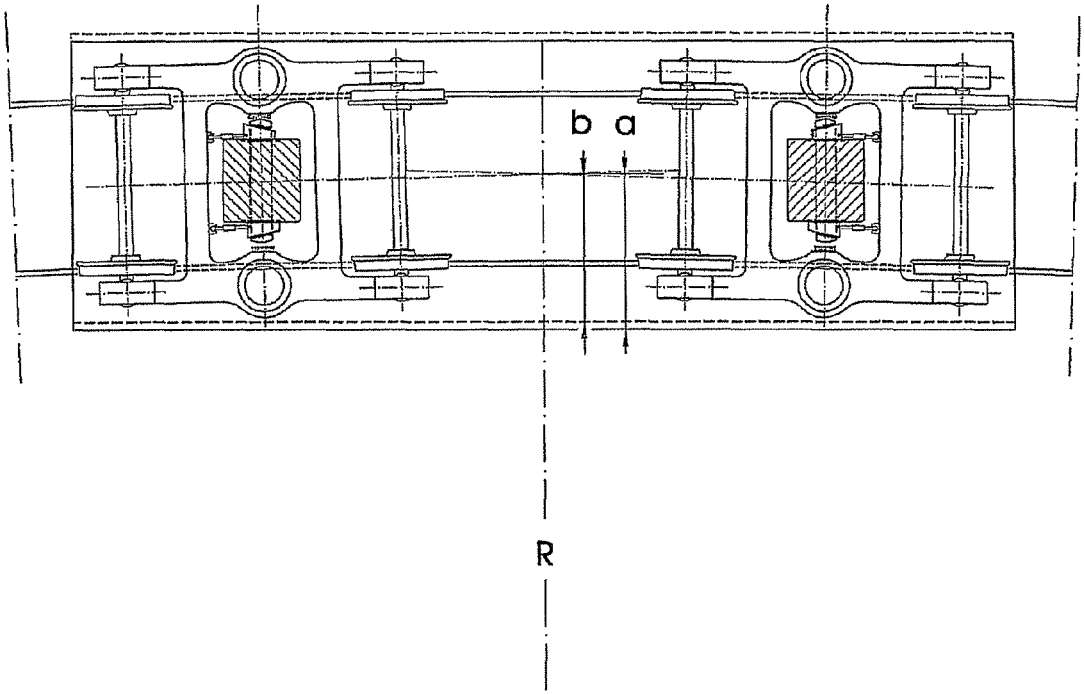
FIG. 1 shows a plan view of the lower part of a body or coach of a rail vehicle with bogies when it is running on a curve.

FIG. 1 shows a ground plan of a body or coach of a rail vehicle with bogies when it is traveling along a curve. The bogies adapt to the curve and form a certain angle with the body axle, as seen in the figure.

The solid line schematically represents the position of the outside edge of the body when the body has shifted towards the inside of the curve. If the lateral edge of the coach located on the inside of the curve is similar to a string with a circumference of radius R (that corresponding to the curve of the inside rail), the distance indicated as "a" in the figure would be the distance of the string to the circumference arch, called sagitta. This distance (the sagitta) limits the width of the body on the inside of the curve.

The dashed line represents the position of the body in which the device of this invention has been implemented to shift the stops of the rail bodies or coaches with bogies when they are entering a curve. As we can see, the lateral edge of the coach located on the inside of the curve stays closer to the inside rail and the lateral edge of the coach located on the outside of the curve is somewhat separated form the outside rail. It is seen that, in this case, the new sagitta "b" is less than sagitta "a" of the solid line position, since the distance "a" has been distributed on both sides—inside and outside—of the curve. This thus enables increasing the width of the coach on the inside part of the curve.

FIG. 1 shows the device of the invention incorporated into the interior cavities bounded by the frames of the two illustrated bogies. We can see the system symmetry, as the device is located to the symmetrical left of the right one.

Of note is the fact that, in all the figures, the traveling direction is towards the right, i.e., when the term front position is used in this document, it will be understood as the front position in the direction of travel (i.e., on the right in the figures), and when rear or back position is used, it will be understood as the rear position in the direction of travel (i.e., on the left in the figures).

Figure 2A:
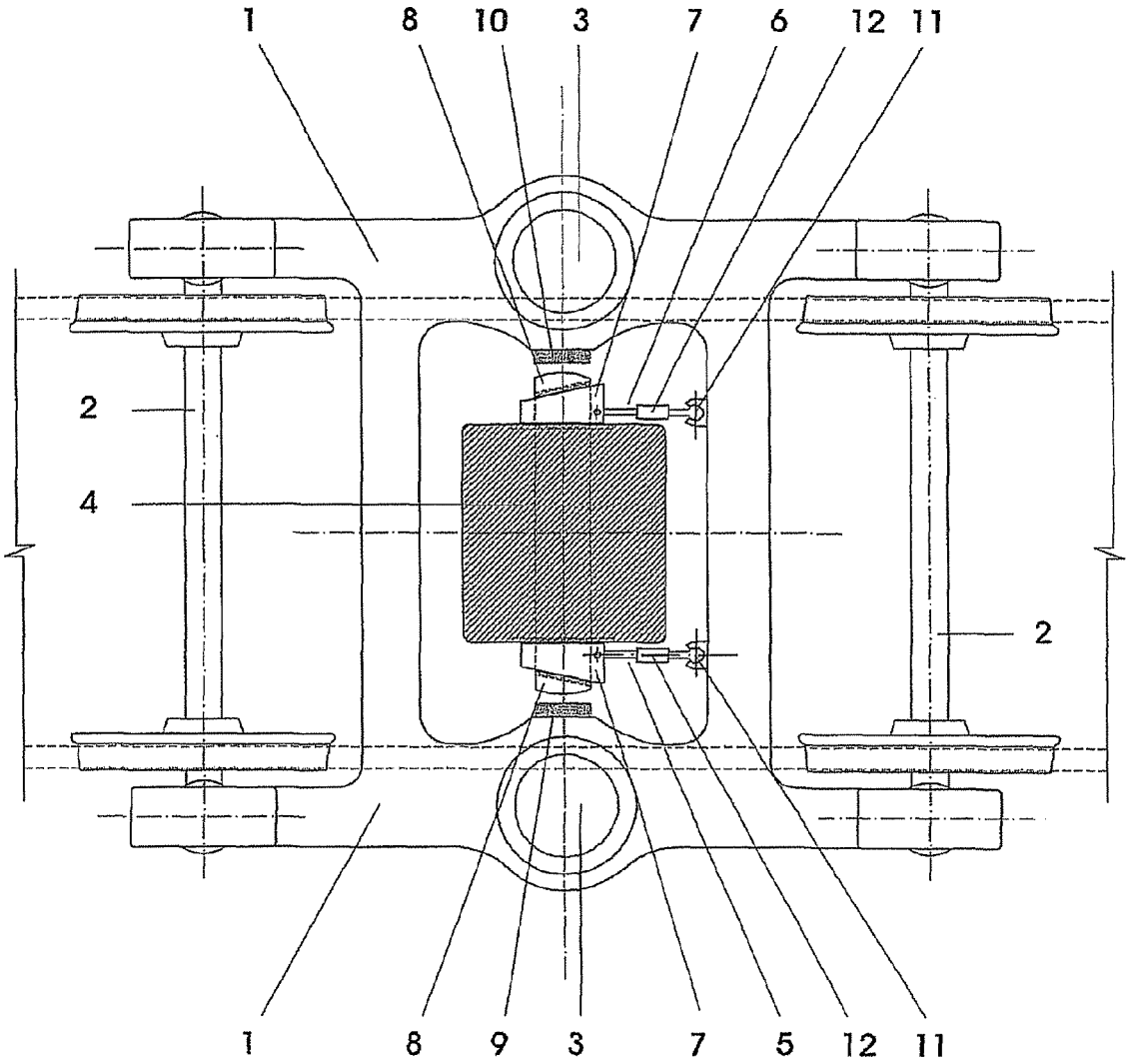
FIG. 2A shows an embodiment of the object of the invention when running on straight tracks.

FIG. 2A shows a plan view of an embodiment of the invention device incorporated into the interior cavity bounded by the frame 1 of a bogie when running on straight tracks. We see that the respective wheels of the bogie are on the rails.

Figure 2B:
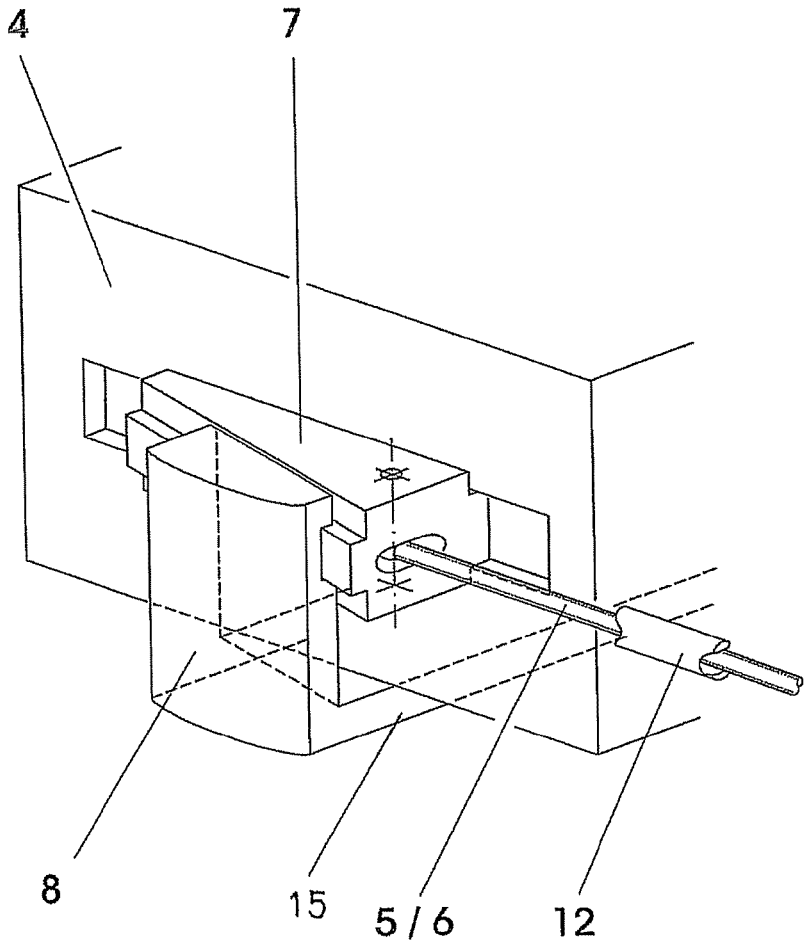
FIG. 2B shows a detail in perspective of the embodiment of the object of the invention in FIG. 2A.

FIG. 2B shows a detail in perspective of the embodiment of the object of the invention in FIG. 2A.

The bogie has a frame 1 with two end axles 2 coupled to those on the respective wheels, located on the respective rails. The location of the suspension elements 3 has also been schematically shown. The frame 1 of the bogie has an interior cavity, bounded by two lateral edges, a front edge and a rear edge. On each of the lateral edges of this interior cavity is a stop 9, centered in FIG. 2A. A lower projecting part 4 is housed in this interior cavity; this part 4 projects from the lower part of the body, to which it can be screwed, for example. It is seen that this lower projecting part 4, shown in cross section, is centered on the cavity of the frame 1 of the bogie when it is running on a straight track; it is also seen that there is clearance between the edges of the lower projecting part 4 and those of the cavity of the bogie frame 1.

On the front edge of the interior cavity of the bogie frame 1, there is a pair of joints 11, arranged symmetrically with respect to the longitudinal axle of the bogie; these can, for example, be ball joints. Coupled to each of these joints 11 is a rod 5, 6 that leads backwards and, on its end opposite to the one located in the joint, each rod is connected to a slider 7 by means of two joints, each located on an end of each of these sliders 7.

The sliders 7 are able to move on some guides located on the lateral surfaces of the lower projecting part 4 of the body, as best seen in FIG. 2B. This figure also shows that the illustrated slider 7 is wedge shaped, with a guide located on its outside surface, and this outside surface of the wedge is in the form of an inclined plane.

FIGS. 2A and 2B also show that the body has two separate stops 8. Each of the stops 8 of the body has an inside surface, which is coupled to the guides located on the inclined plane corresponding to the outside surface of the slider 7; these inside surfaces of the body stops 8 thus have the same inclination as the inclined planes of the sliders 7 to which they are coupled.

The body stops 8 are joined together by guided transversal connection means 15 so that they prevent the longitudinal movement of these stops 8 with respect to the lower projecting part 4 of the body. FIG. 2B shows that the transversal connections means 15 in the illustrated embodiment are transversal tie-rods, guided by the lower surface of the lower projecting part 4 of the body.

The body stops 8 preferentially have a rounded, curved-convex outside surface, so that they can perform the function of stop elements, with the ability to contact with the corresponding stops 9, 10 located on the lateral edges of the interior cavity of the bogie frame 1.

FIG. 1 shows how the device functions to shift the stops 8 of the rail vehicle bodies when running on a curve. On entering a curve, the bogies adapt to the curve and form a certain angle with the body axle. This FIG. 1 shows that the axles (dashed line) of the two bogies corresponding to the schematically illustrated body form opposite angles through the vertex with the body axle.

The lower projecting parts 4 of the body (one per bogie) are built into the body; therefore, their edges remain parallel to the respective outside edges of the body when it enters a curve, as seen in the embodiment of FIG. 1.

When the bogies adapt to the curve, the relative position of each bogie changes with respect to the corresponding lower projecting part 4 of the body. The inside edges of the frame 1 of each bogie and the edges of the corresponding lower projecting part 4 are no longer parallel (as occurs when running on a straight track). Therefore, in the area located on the inside of the curve of the device placed on the right (front) of FIG. 1, the corresponding slider 7 shifts backwards on the corresponding guide, whereby the lateral stop 8 of the body is pushed and projects laterally, approaching the corresponding stop 9 of the bogie frame 1. In the area located on the outside of the curve of the device placed on the right (front) of FIG. 1, the corresponding slider 7 shifts forwards on the corresponding guide, whereby the lateral stop 8 of the body moves away from the corresponding stop 10 of the bogie frame 1. As they are connected by connection means 15, the shifting of both stops is the same.

In the device located on the left (rear) of FIG. 1, the corresponding stops 8 of the body also shift; in the area located on the inside of the curve of the device placed on the left (rear) of FIG. 1, the corresponding slider 7 shifts forwards on the corresponding guide, whereby the lateral stop 8 of the body projects laterally and approaches the corresponding stop 9 of the bogie frame 1. In the area located on the outside of the curve of the device placed on the left (rear) of FIG. 1, the corresponding slider 7 shifts backwards on the corresponding guide, whereby the lateral stop 8 of the body moves away from the corresponding stop 10 of the bogie frame 1.

Thus we see that, when the body shifts (and accordingly its lower projecting parts 4) towards the inside of the curve, both in the device on the right (front) and in the device on the left (rear) each body stop 8 located on the inside of the curve approaches the corresponding stop 9 of the bogie frame 1, eventually making contact with it and thereby limiting the body's shift towards the inside of the curve.

Figure 3A:
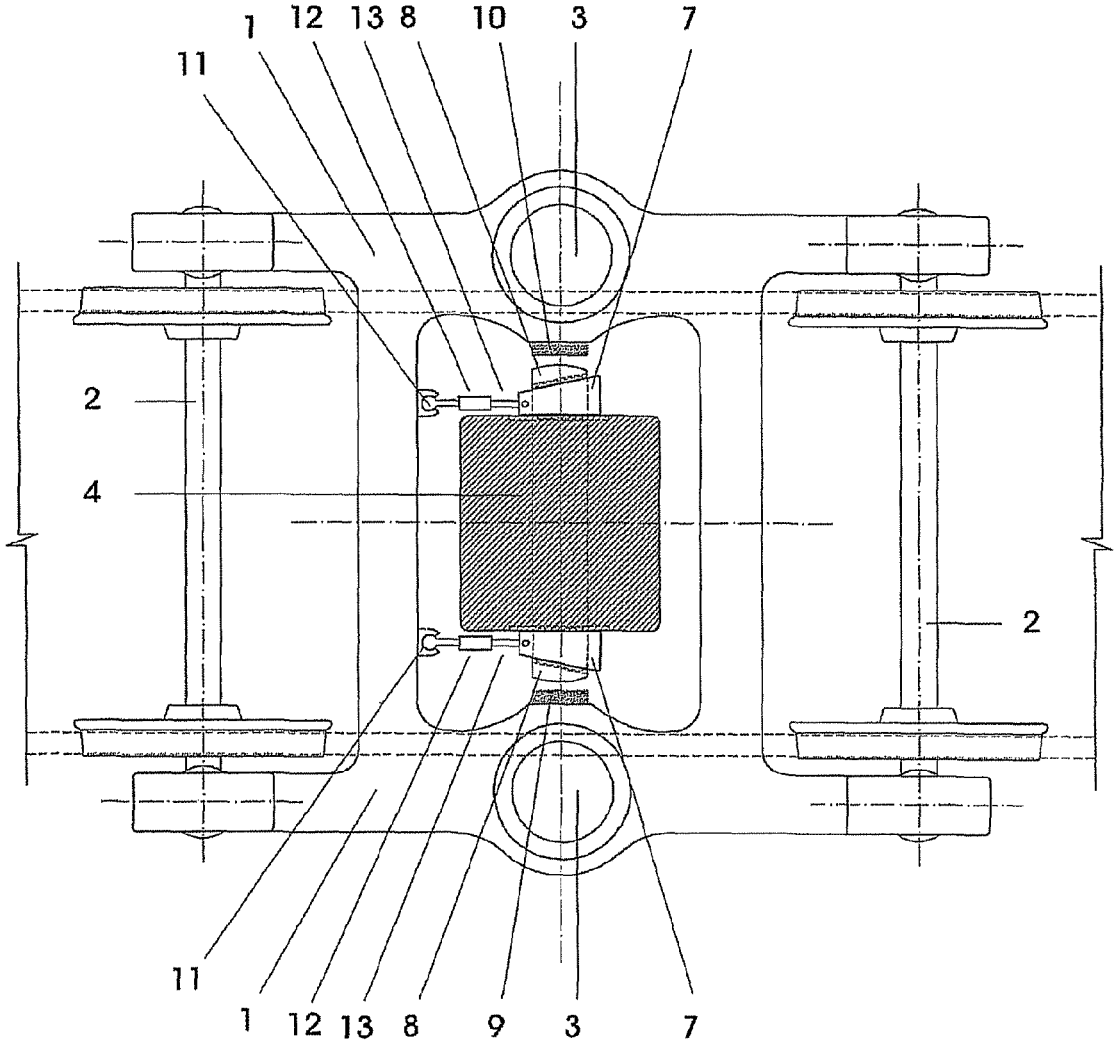
FIG. 3A shows another embodiment of the object of the invention when running on straight tracks.
Figure 3B:
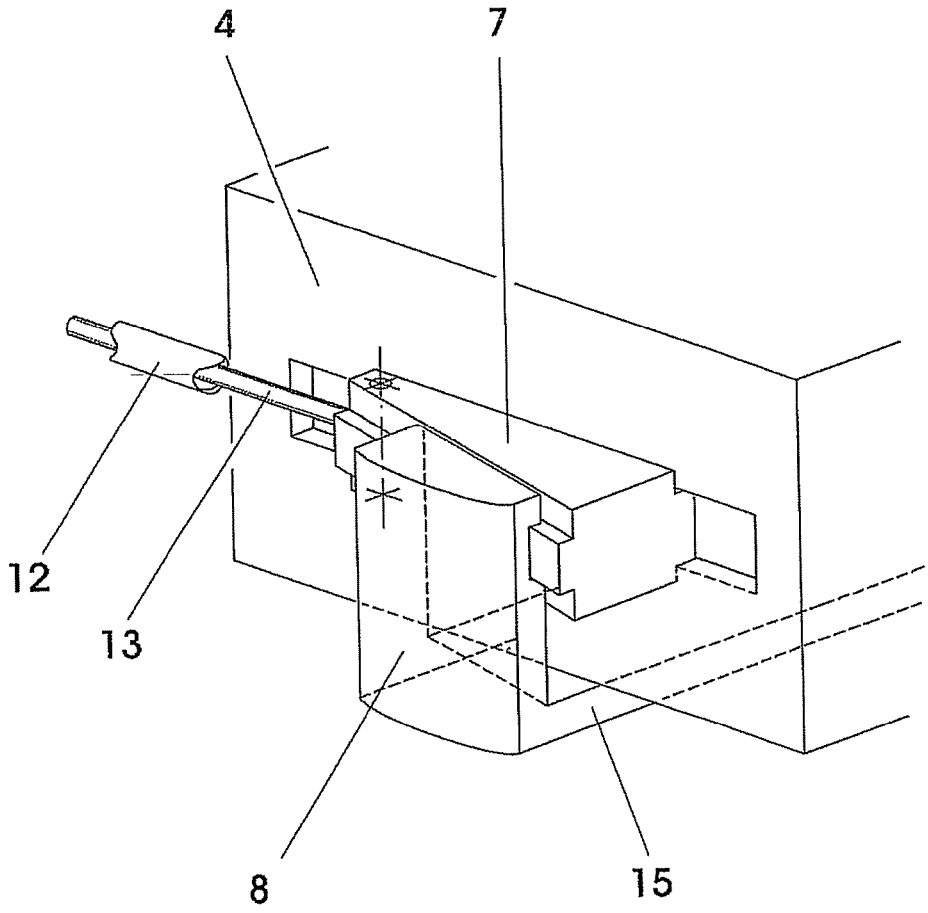
FIG. 3B shows a detail in perspective of the embodiment of the object of the invention in FIG. 3A.

In another embodiment of the invention, shown in FIGS. 3A and 3B, the device to shift the stops 8 of the bodies has a configuration similar to the one of the device shown in FIGS. 2A and 2B, with the difference that the pair of joints 11 symmetrically arranged with respect to the longitudinal axle of the bogie is located on the rear edge of the interior opening of the bogie frame 1 and, therefore, from each of these joints 11 a rod 13 leads forward and on the other end they are joined to the sliders 7 by means of two joints, each located on an end of each of these sliders 7.

The device of this second embodiment would thus function similarly to that of the first embodiment. If, in the body shown in FIG. 1, the device of the second embodiment is incorporated into the right bogie (front), when the body (and accordingly its lower projecting parts 4) shifts towards the inside of the curve, in this device the body stop 8 located on the inside of the curve would approach the corresponding stop 9 of the bogie frame 1, eventually making contact with it and thereby limiting the body's shift towards the inside of the curve.

The same would happen with the device symmetrical to that of FIGS. 3A and 3B and located in the left bogie (rear), in which the corresponding stop 8 of the body located on the inside of the curve would approach the corresponding stop 9 of the bogie frame 1.

Figure 4A:
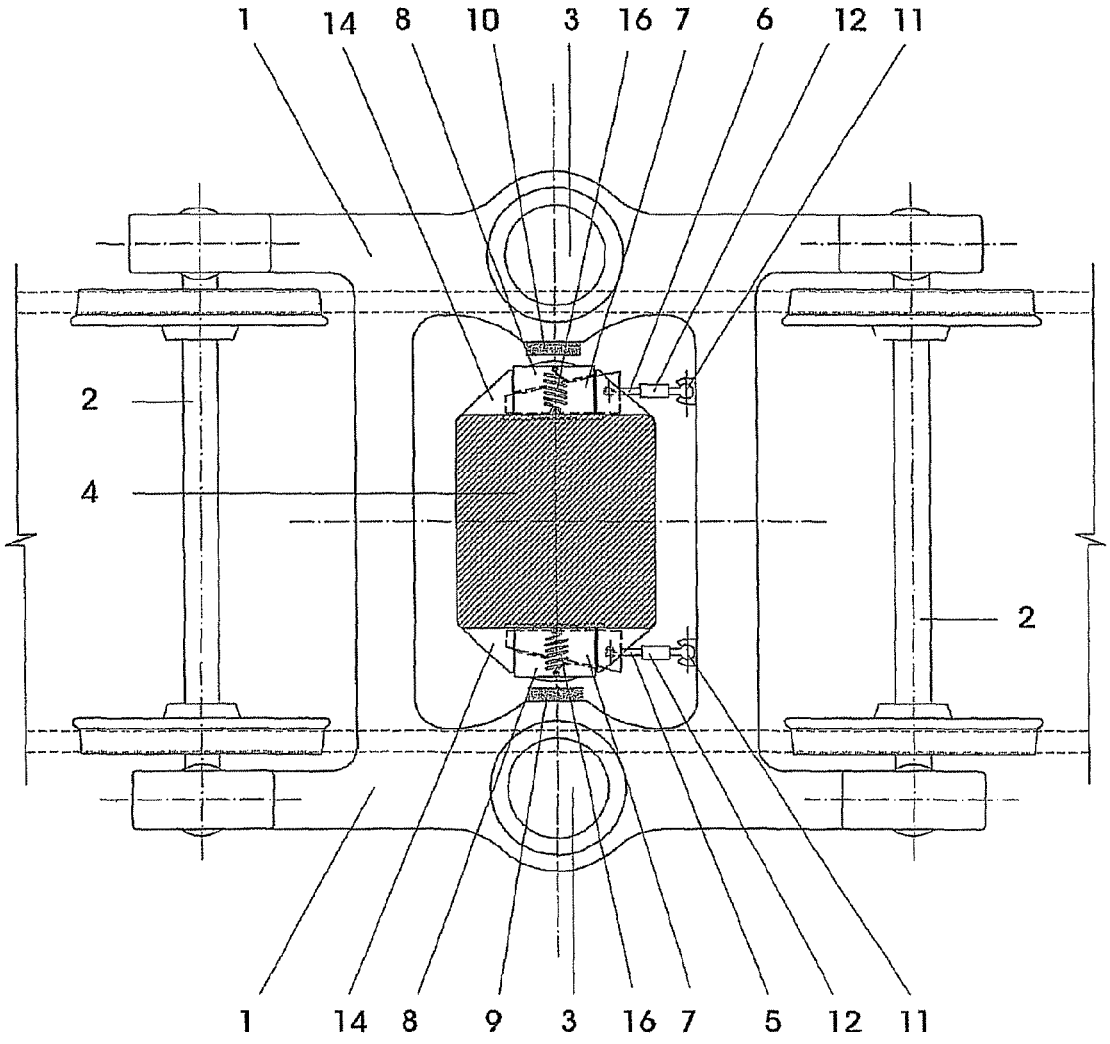
FIG. 4A shows another embodiment of the object of the invention when running on straight tracks.

FIG. 4A shows a plan view of another embodiment of the device of the invention incorporated into the interior cavity bounded by the bogie frame 1 when running on straight tracks. We see that the respective wheels of the bogie are on the rails FIG. 4B shows a detail in perspective of the embodiment of the object of the invention in FIG. 4A.

The bogie has a frame 1 with 2 coupled end axles which hold the respective wheels, located on the respective rails. The location of the suspension elements 3 has also been schematically illustrated. The bogie frame 1 has an interior cavity bounded by two lateral edges, a front edge and a rear edge. Each lateral edge has a stop 9, 10, centered in FIG. 4A. In this interior cavity a lower projecting part 4 is housed; this part 4 projects from the lower part of the body, to which it can be screwed, for example. It is seen that this lower projecting part 4, shown in cross section, is centered on the cavity of the frame 1 of the bogie when it is running on a straight track; it is also seen that there is clearance between the edges of the lower projecting part 4 and those of the cavity of the bogie frame 1.

On the front edge of the interior cavity of the bogie frame 1, there is a pair of joints 11, arranged symmetrically with respect to the longitudinal axle of the bogie. Coupled to each of these joints 11 is a rod 5, 6 that leads backwards and, on its end opposite to the one located in the joint, each rod is connected to a slider 7 by means of two joints, each located on an end of each of these sliders 7.

Figure 4B:
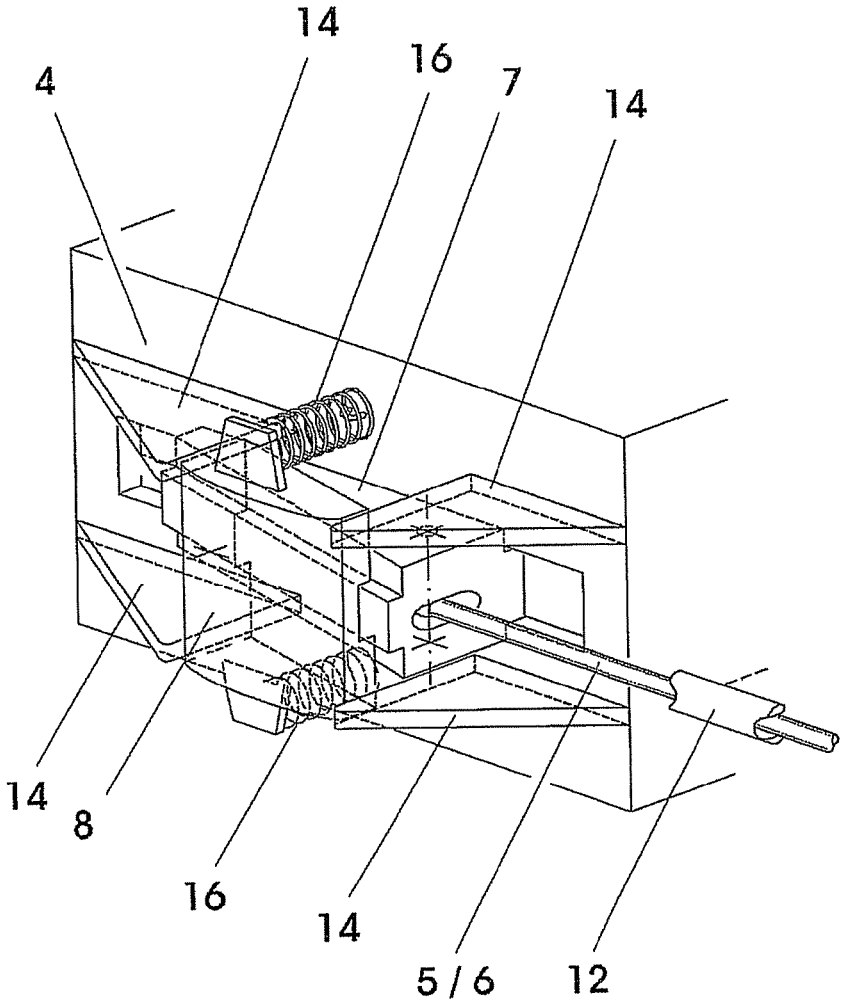
FIG. 4B shows a detail in perspective of the embodiment of the object of the invention in FIG. 4A.

The sliders 7 are able to move on some guides located on the lateral surfaces of the lower projecting part 4, as best seen in FIG. 4B. This figure also shows that the illustrated slider 7 is wedge shaped, with a guide located on its outside surface, and this outside surface of the wedge is in the form of an inclined plane.

FIGS. 4A and 4B also show that there is a pair of stops 8 for the body. Each of these stops 8 is coupled on its inside surface to the guide located on the inclined plane corresponding to the outside surface of the slider 7, as the inside surface of the body stops 8 has the same inclination as the inclined plane of the corresponding slider 7, which makes it possible to couple it to its guide.

These body stops 8 are joined to the respective lateral edge of the lower projecting part 4 of the body by elastic means 16, preferentially springs. In the embodiment shown, the springs are secured to small plates built into the stop 8, as shown in FIG. 4B.

Likewise, these body stops 8 can move in transversal direction, and they are guided by some stop end means 14 that prevent their relative movement forwards or backwards.

These stop means 14 can be in the form of angle brackets. In the embodiment shown in FIG. 4B, these angle brackets are arranged by pairs above and below the slider 7, on the front and rear parts of the respective lateral surface of the lower projecting part 4 of the body; therefore they are vertically and horizontally aligned.

If in FIG. 1 we implemented the device to shift the body stops 8 of FIGS. 4A and 4B, in the area located on the inside of the curve of the device placed on the right (front) of FIG. 1, the corresponding slider 7 would shift backwards on the corresponding guide, whereby the lateral stop 8 of the body would be pushed and would project laterally, approaching the corresponding stop 9 of the bogie frame 1. The stop ends 14, shown as angle brackets in the figure, would guide the transversal movement of the stops 8 and would prevent their longitudinal movement.

In the area located on the outside of the curve of the device placed on the right (front) of FIG. 1, the corresponding slider 7 would shift forwards on the corresponding guide, whereby the lateral stop 8 of the body would move away from the corresponding stop 10 of the bogie frame 1.

On returning to a straight line, due to the action of the elastic means 16, the stops 8 of the body would return to their normal position on the sliders 7.

Therefore, when the body (and accordingly its lower projecting parts 4) shifts towards the inside of the curve, in the device on the right (front) the body stop 8 located on the inside of the curve approaches the corresponding stop 9 of the bogie frame 1, eventually making contact with it and thereby limiting the body's shift towards the inside of the curve, similarly to what happens in the previous embodiments.

In the device on the left (rear), symmetrical to the one on the right, the body stop 8 located on the inside of the curve would approach the corresponding stop 9 of the bogie frame 1, eventually making contact with it.

Figure 5A:
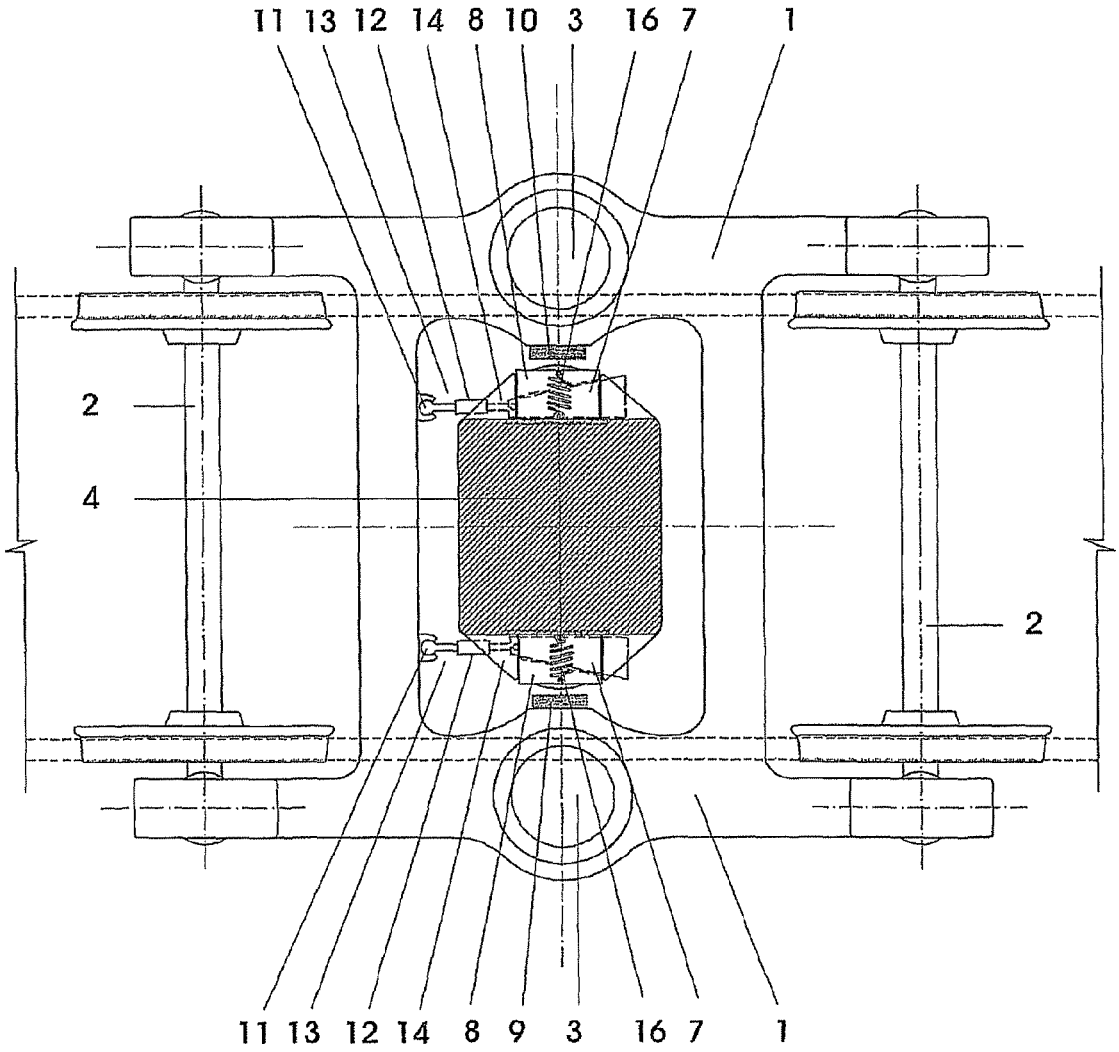
FIG. 5A shows another embodiment of the object of the invention when running on straight tracks.
Figure 5B:
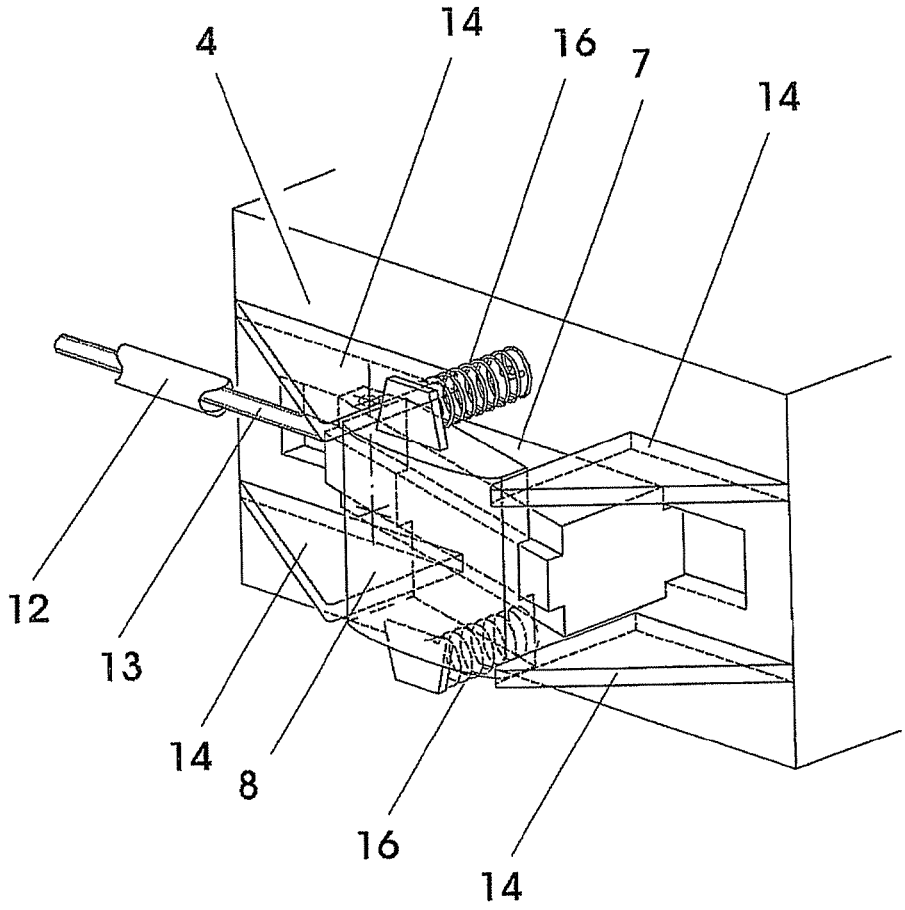
FIG. 5B shows a detail in perspective of the embodiment of the object of the invention in FIG. 5A.

In another embodiment of the invention, shown in FIGS. 5A and 5B, the device to shift the stops 8 of the bodies has a configuration similar to the one of the device shown in FIGS. 4A and 4B, with the difference that the pair of joints 11 symmetrically arranged with respect to the longitudinal axle of the bogie is located on the rear edge of the interior cavity of the bogie frame 1 and, therefore, from each of these joints 11 a rod 13 leads forward and on the other end of these they are joined to the sliders 7 by means of two joints, each located on an end of each of these sliders 7.

The device of the embodiment of FIGS. 5A and 5B would thus function similarly to that of the embodiment of FIGS. 4A and 4B. If, in the body shown in FIG. 1, the device of the embodiment of FIGS. 5A and 5B is incorporated into the cavity of the frame 1 of each bogie, when the body (and accordingly its lower projecting parts 4) shifts towards the inside of the curve, in the area located on the inside of the curve of the device placed on the right (front) of FIG. 1, the corresponding slider 7 would shift backwards on the corresponding guide, whereby the lateral stop 8 of the body would be pushed and would project laterally, approaching the corresponding stop 9 of the bogie frame 1. The stop ends 14, shown as angle brackets in the figure, would guide the transversal movement of the stops and would prevent their longitudinal movement.

In the device on the left (rear), symmetrical to the one on the right, the body stop 8 located on the inside of the curve would approach the corresponding stop 9 of the bogie frame 1, eventually making contact with it.

In all the embodiments, the rods 5, 6, 13 can be equipped with an intermediate safety element 12 to protect against blocking which, in the event that the system blocks, would enable the bogie to swivel in relation to the body. This element can, for example, consist of pre-compressed springs (one traction and one compression) or be a hydraulic element that can yield to a high force.

The thrust rods 5, 6, 13 can also be control rods that act on electric or hydraulic servos such that these will control the lateral movement of the stops 8.

In addition, the outside surface of the body stops 8 will preferentially be rounded, with convex curvature.

It should be noted that the body of FIG. 1 preferentially incorporates any of the described embodiments of the device to shift the stops 8 in the interior cavity of the front bogie frame 1, and a device to shift the stops 8 of the bodies that is symmetrical to the former in the interior cavity of the rear bogie frame 1.

Any modifications included within the scope defined by the following claims may be made to the preferential embodiments of the invention that we have just described.

The invention claimed is:

1. Device to shift body stops (8) of rail vehicle bodies with bogies on curves, in which a bogie frame (1) bounds an interior cavity whose lateral edges each have a stop (9, 10) and that houses a lower projecting part (4) of the body, such that there are clearances between the lateral edges of the frame (1) of the bogie and corresponding lateral edges of the lower projecting part (4) of the body, characterized in that the device comprises a pair of first joints (11) arranged symmetrically with respect to a longitudinal axle of the bogie and located on a front edge of an interior cavity of the bogie frame (1), a rod (5, 6) leading backward from a corresponding joint of the pair of first joints, the other end of each rod (5, 6) joined to a slider (7) by means of a second joint, each second joint located on an end of each of the sliders (7), where the sliders (7) are able to move on guides located on the respective lateral edges of the lower projecting part (4) of the body, and the sliders (7) are wedge-shaped with a guide located on an outside surface of each slider (7) in the form of an inclined plane, and in that the body stops (8) of the body are coupled, on respective inside surfaces of the body stops (8), to the guides located on the inclined planes corresponding to the outside surfaces of the respective sliders (7), where the inside surfaces of the body stops (8) have the same inclination as the inclined planes of the sliders (7), and the body stops (8) are joined together by guided transversal connection means (15) such that transversal connection means (15) prevent longitudinal movement of the body stops (8) with respect to the lower projecting part (4) of the body.

2. The device of claim 1, characterized in that the transversal connection means (15) that join the body stops (8) together are tie-rods.

3. The device of claim 1, characterized in that an outside surface of the body stops (8) is rounded, with convex curvature.

4. The device of claim 1, characterized in that the rods (5, 6) have an intermediate safety element (12) to protect against blocking

5. The device of claim 4, characterized in that the intermediate safety element (12) against blocking consists of pre-compressed springs.

6. Railway vehicle body comprising two bogies, one bogie located at a front of the vehicle body and another bogie located at a rear of the vehicle body, characterized in that the vehicle body incorporates in an interior cavity of a front bogie frame (1) of the vehicle body the device of claim 1, and in an interior cavity of a rear bogie frame (1) a device to shift the stops (8) of the bodies that is symmetrical to the device associated with the front bogie frame (1).

7. Device to shift body stops (8) of rail vehicle bodies with bogies on curves, in which a bogie frame (1) bounds an interior cavity whose lateral edges each have a stop (9, 10) and that houses a lower projecting part (4) of the body, such that there are clearances between the lateral edges of the bogie frame (1) and the corresponding lateral edges of the lower projecting part (4) of the body, characterized in that the device comprises a pair of first joints (11) arranged symmetrically with respect to a longitudinal axle of the bogie and located on the rear edge of the interior cavity of the bogie frame (1), a rod (13) leading forward from a corresponding joint of the pair of first joints, each rod (13) joined to a slider (7) by means of a second joint, each second joint located on an end of each of the sliders (7), where the sliders (7) are able to move on guides located on the respective lateral edges of the lower projecting part (4) of the body, and the sliders (7) are wedge-shaped with a guide located on an outside surface of each slider (7) in the form of an inclined plane, and in that the body stops (8) are coupled, on respective inside surfaces, to the guides located on the inclined planes corresponding to the outside surfaces of the respective sliders (7), where the inside surfaces of the body stops (8) have the same inclination as the inclined planes of the sliders (7), and the body stops (8) are joined together by guided transversal connection means (15) such that the transversal connection means prevent the longitudinal movement of the body stops (8) with respect to the lower projecting part (4) of the body.

8. The device of claim 7, characterized in that the transversal connection means (15) that join the body stops (8) together are tie-rods.

9. The device of claim 7, characterized in that an outside surface of the body stops (8) is rounded, with convex curvature.

10. The device of claim 7, characterized in that the rods (13) have an intermediate safety element (12) to protect against blocking

11. The device of claim 10, characterized in that the intermediate safety element (12) against blocking consists of precompressed springs.

12. Railway vehicle body comprising two bogies, one bogie located at a front of the vehicle body and another bogie located at a rear of the vehicle body, characterized in that the vehicle body incorporates in an interior cavity of a front bogie frame (1) of the vehicle body the device of claim 7, and in an interior cavity of a rear bogie frame (1) a device to shift the stops (8) of the bodies that is symmetrical to the device associated with the front bogie frame (1).

13. Device to shift body stops (8) of rail vehicle bodies with bogies on curves, in which a bogie frame (1) bounds an interior cavity whose lateral edges each have a stop (9, 10) and that houses a lower projecting part (4) of the body, such that there are clearances between the lateral edges of the bogie frame (1) of the bogie and corresponding lateral edges of the lower projecting part (4) of the body, characterized in that the device comprises a pair of first joints (11) arranged symmetrically with respect to a longitudinal axle of the bogie and located on a front edge of an interior cavity of the bogie frame (1), a rod (5, 6) leading backward from a corresponding joint of the pair of first joints, each rod (5, 6) joined to a slider (7) by means of a second joint, each second joint located on an end of each of the sliders (7), where the sliders (7) are able to move on guides located on the respective lateral edges of the lower projecting part (4) of the body, and the sliders (7) are wedge-shaped with a guide located on an outside surface of each slider (7) in the form of an inclined plane, and in that each body stop (8) of the body is coupled, on a respective inside surface of the body stop (8), to the guide located on the inclined plane corresponding to the outside surface of the slider (7), where the inside surface of each body stop (8) has the same inclination as the inclined plane of the corresponding slider (7), and these body stops (8) are joined to the respective lateral edge of the lower projecting part (4) of the body by elastic means (16) and are guided in the transversal direction by appropriate means of stop ends (14).

14. The device of claim 13, characterized in that the elastic means (16) are springs.

15. The device of claim 13, characterized in that the stop end means (14) are angle brackets located above and below the sliders (7) on the front and rear parts of the respective lateral edges of the lower projecting part (4) of the body.

16. The device of claim 13, characterized in that an outside surface of the body stops (8) is rounded, with convex curvature.

17. The device of claim 13, characterized in that the rods (5, 6) have an intermediate safety element (12) to protect against blocking

18. The device of claim 17, characterized in that the intermediate safety element (12) against blocking consists of precompressed springs.

19. Railway vehicle body comprising two bogies, one bogie located at a front of the vehicle body and another bogie located at a rear of the vehicle body, characterized in that the vehicle body incorporates in an interior cavity of a front bogie frame (1) of the vehicle body the device of claim 13, and in an interior cavity of a rear bogie frame (1) a device to shift the stops (8) of the bodies that is symmetrical to the device associated with the front bogie frame (1).

20. Device to shift body stops (8) of rail vehicle bodies with bogies on curves, in which a bogie frame (1) bounds an interior cavity whose lateral edges each have a stop (9, 10) and that houses a lower projecting part (4) of the body, such that there are clearances between the lateral edges of the bogie frame (1) and corresponding lateral edges of the lower projecting part (4) of the body, characterized in that the bogie frame comprises a pair of first joints (11) arranged symmetrically with respect to a longitudinal axle of the bogie and located on a rear edge of an interior cavity of the bogie frame (1), a rod (13) leading forward from a corresponding joint of the pair of first joints, each rod (13) joined to a slider (7) by means of a second joint, each second joint located on an end of each of the sliders (7), where the sliders (7) are able to move on guides located on the respective lateral edges of the lower projecting part (4) of the body, and the sliders (7) are wedge-shaped with a guide located on an outside surface of each slider (7) in the form of an inclined plane, and in that each body stop (8) is coupled, on a respective inside surface of the body stop (8), to the guide located on the inclined plane corresponding to the outside surface of the slider (7), where the inside surface of each body stop (8) has the same inclination as the inclined plane of the corresponding slider (7), and the body stops (8) are joined to the respective lateral edge of the lower projecting part (4) of the body by elastic means (16) and are guided in the transversal direction by appropriate means of stop ends (14).

21. The device of claim 20, characterized in that the elastic means (16) are springs.

22. The device of claim 21, characterized in that the stop end means (14) are angle brackets located above and below the sliders (7) on the front and rear parts of the respective lateral edges of the lower projecting part (4) of the body.

23. The device of claim 20, characterized in that an outside surface of the body stops (8) is rounded, with convex curvature.

24. The device of claim 20, characterized in that the rods (13) have an intermediate safety element (12) to protect against blocking.

25. The device of claim 24, characterized in that the intermediate safety element (12) against blocking consists of pre-compressed springs.

26. Railway vehicle body comprising two bogies, one bogie located at a front of the vehicle body and another bogie located at a rear of the vehicle body, characterized in that the vehicle body incorporates in an interior cavity of a front bogie frame (1) of the vehicle body the device of claim 20, and in an interior cavity of a rear bogie frame (1) a device to shift the stops (8) of the bodies that is symmetrical to the device associated with the front bogie frame (1).

27. The device of claim 20, characterized in that the stop end means (14) are angle brackets located above and below the sliders (7) on the front and rear parts of the respective lateral edges of the lower projecting part (4) of the body.

* * * * *

UNITED STATES PATENT AND TRADEMARK OFFICE

CERTIFICATE OF CORRECTION

PATENT NO. : 8,590,461 B2
APPLICATION NO. : 13/139929
DATED : November 26, 2013
INVENTOR(S) : José Luis López Gómez It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 286 days.

Signed and Sealed this
Twenty-second Day of September, 2015

Michelle K. Lee

Michelle K. Lee
*Director of the United States Patent and Trademark Office*